US005092373A

United States Patent [19]

Lee

[11] Patent Number: 5,092,373

[45] Date of Patent: Mar. 3, 1992

[54] PAPERMAKERS FABRIC WITH ORTHOGONAL MACHINE DIRECTION YARN SEAMING LOOPS

[75] Inventor: Henry J. Lee, Summeville, S.C.

[73] Assignee: Asten Group, Inc., Charleston, S.C.

[21] Appl. No.: 567,974

[22] Filed: Aug. 15, 1990

Related U.S. Application Data

[63] Continuation-in-part of Ser. No. 534,164, Jun. 6, 1990.

[51] Int. Cl.[5] ..... D03D 13/00

[52] U.S. Cl. ..... 139/383 AA

[58] Field of Search ..... 139/383 AA; 162/DIG. 1, 162/358; 428/222

[56] References Cited

U.S. PATENT DOCUMENTS

| | | | |
|---|---|---|---|
| 1,050,406 | 1/1913 | Veit . | |
| 2,854,032 | 8/1953 | Santos . | |
| 3,622,415 | 11/1971 | Kunsman | 139/383 AA |
| 4,026,331 | 5/1977 | Lees et al. . | |
| 4,123,022 | 10/1978 | Dutt et al. . | |
| 4,142,557 | 3/1979 | Kositzke . | |
| 4,290,209 | 9/1981 | Buchanan et al. . | |
| 4,351,874 | 9/1982 | Kirby . | |
| 4,356,225 | 10/1982 | Dufour . | |
| 4;438,788 | 3/1984 | Harwood . | |
| 4,438,789 | 3/1984 | MacBean . | |
| 4,461,803 | 7/1984 | Booth et al. . | |
| 4,469,142 | 9/1984 | Harwood . | |
| 4,537,816 | 8/1985 | Booth et al. . | |
| 4,621,663 | 11/1986 | Malmendier . | |
| 4,755,420 | 7/1988 | Baker et al. . | |
| 4,815,499 | 3/1989 | Johnson . | |
| 4,824,525 | 4/1989 | Penven . | |
| 4,846,231 | 7/1989 | Penven . | |
| 4,865,083 | 9/1989 | Cunnane . | |
| 4,883,096 | 11/1989 | Penven . | |
| 4,887,648 | 12/1989 | Cunnane | 139/383 AA |
| 4,902,383 | 2/1990 | Penven | 139/383 AA |
| 4,938,269 | 7/1990 | Nicholas et al. | 139/383 AA |

FOREIGN PATENT DOCUMENTS

| | | |
|---|---|---|
| 144592 | 6/1985 | European Pat. Off. . |
| 211426 | 2/1987 | European Pat. Off. . |
| 2407291 | 5/1979 | France . |

*Primary Examiner*—Andrew M. Falik

*Attorney, Agent, or Firm*—Volpe and Koenig

[57] ABSTRACT

A woven pin-seamed papermakers fabric wherein machine direction yarns define a series of orthogonal seaming loops on the opposing fabric ends. The fabric comprises a system of flat monofilament machine direction yarns (hereinafter MD yarns) which are woven in a selected weave construction. In a preferred embodiment, the system of MD yarns comprises upper and lower yarns which are vertically stacked. End segments of the lower MD yarns are removed and the upper MD yarn ends are looped back upon themselves and rewoven into the fabric end in the space vacated by the trimmed lower MD yarn end segments. Non-loop forming upper MD yarns are also preferably backwoven into the space vacated by trimming the respective lower MD yarns. Preferably, at least the upper MD yarns are woven contiguous with each other to lock in the machine direction alignment of the stacking pairs of MD yarns and the orthogonal orientation of the end loops.

19 Claims, 3 Drawing Sheets

PAPERMAKERS FABRIC WITH ORTHOGONAL MACHINE DIRECTION YARN SEAMING LOOPS

This application is a continuation-in-part of my copending application, Ser. No. 07/534,164, entitled PAPERMAKERS FABRIC WITH STACKED MACHINE DIRECTION YARNS, filed June 6, 1990, which application is incorporated by reference herein as if fully set forth.

The present invention relates to papermakers fabrics and in particular to pin-seamed fabrics.

BACKGROUND OF THE INVENTION

Papermaking machines generally are comprise sections: forming, pressing, and drying. Papermakers fabrics are employed to transport a continuous paper sheet through the papermaking equipment as the paper is being manufactured. The requirements and desirable characteristics of papermakers fabrics vary in accordance with the particular section of the machine where the respective fabrics are utilized.

With the development of synthetic yarns, shaped monofilament yarns have been employed in the construction of papermakers fabrics. For example, U.S. Pat. No. 4,290,209 discloses a fabric woven of flat monofilament warp yarns; U.S. Pat. No. 4,755,420 discloses a non-woven construction where the papermakers fabric is comprised of spirals made from flat monofilament yarns.

In use, papermakers fabrics are configured as endless belts. Weaving techniques are available to initially weave fabrics endless. However, there are practical limitations on the overall size of endless woven fabrics as well as inherent installation difficulties. Moreover, not all papermaking equipment is designed to accept the installation of an endless fabric.

Flat woven fabrics are often supplied having opposing ends which are seamed together during installation of the fabric on papermaking equipment. Usually one end of the fabric is threaded through the serpentine path defined by the papermaking equipment and is then joined to its opposing end to form a continuous belt.

A variety of seaming techniques are well known in the art. One conventional method of seaming is to form the machine direction yarns on each end of the fabric into a series of loops. The loops of the respective fabric ends are then intermeshed during fabric installation to define a channel through which a pintle is inserted to lock the ends together.

For example, U.S. Pat. Nos. 4,026,331; 4,438,789; 4,469,142; 4,846,231; 4,824,525 and 4,883,096 disclose a variety of pin seams wherein the machine direction yarns are utilized to form the end loops. In each of those patents, however, the machine direction yarn projects from the end of the fabric and weaves back into the fabric adjacent to itself. Accordingly, the loops inherently have a twist or torque factor and are not entirely orthogonal to the plane of the fabric. U.S. Pat. 4,883,096 specifically addresses this problem.

It would be desirable to provide a papermakers fabric with machine direction seaming loops which do not have torque and/or twist.

SUMMARY AND OBJECTS INVENTION

The present invention is directed to a woven, pin-seamed papermakers fabric wherein machine direction yarns define a series of orthogonal seaming loops on the opposing fabric ends. The fabric comprises a system of flat monofilament machine direction yarns (hereinafter MD yarns) which are woven in a selected weave construction. In a preferred embodiment, the system of MD yarns comprises upper and lower yarns which are vertically stacked. End segments of the lower MD yarns are removed and the upper MD yarn ends are looped back upon themselves and rewoven into the fabric end in the space vacated by the trimmed lower MD yarn end segments. The lower MD yarns may weave in an inverted image of the upper MD yarns such that the crimp of the upper MD yarns conforms with the lower MD yarn weave pattern space into which the upper MD yarn ends are backwoven. This improves the strength of the seam.

Non-loop forming upper MD yarns are also preferably backwoven into the space vacated by trimming the respective lower MD yarns. Preferably, at least the upper MD yarns are woven contiguous with each other to lock in the machine direction alignment of the stacking pairs of MD yarns and the orthogonal orientation of the end loops. In the preferred embodiment, the same type of material and the same geometric shape and size yarns are used throughout the machine direction yarn system and both the top and the bottom MD yarns weave contiguously with adjacent top and bottom MD yarns, respectively.

DETAILED DESCRIPTION OF PRESENTLY PREFERRED EMBODIMENTS

Figure 1:
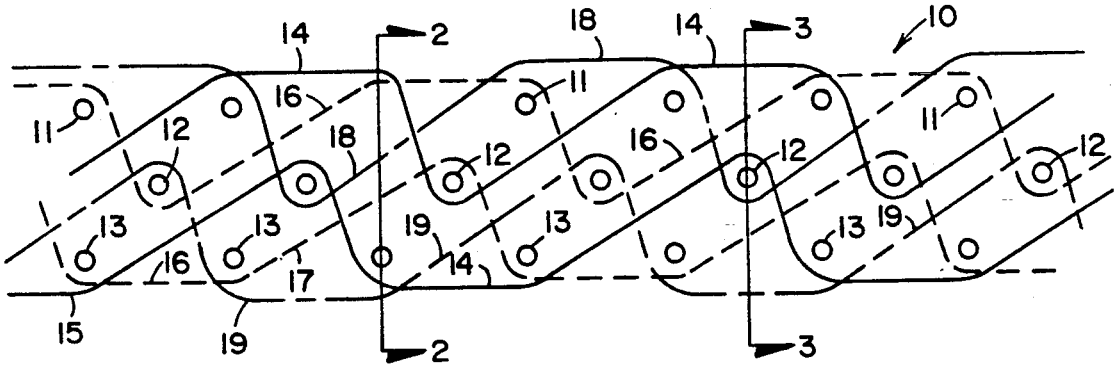
FIG. 1 is a schematic diagram of a papermakers fabric made in accordance with the teachings of the present invention.
Figure 2:
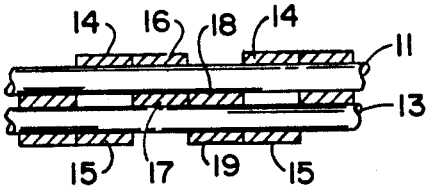
FIG. 2 is a cross-sectional view of the fabric depicted in FIG. 1 along line 2—2.
Figure 3:
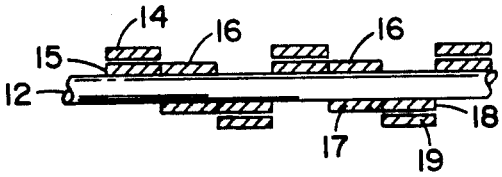
FIG. 3 is a cross-sectional view of the fabric depicted in FIG. 1 along line 3—3.

Referring to FIGS. 1, 2, and 3, there is shown a papermakers dryer fabric 10 comprising upper, middle and lower layers of cross machine direction (hereinafter CMD) yarns 11, 12, 13, respectively, interwoven with a system of MD yarns 14–19 which sequentially weave in a selected repeat pattern. The MD yarn system comprises upper MD yarns 14, 16, 18 which interweave with CMD yarns 11, 12 and lower MD yarns 15, 17, 19 which interweave with CMD yarns 12, 13.

The upper MD yarns 14, 16, 18 define floats on the top surface of the fabric 10 by weaving over two upper layer CMD yarns 11 dropping into the fabric to weave in an interior knuckle under one middle layer CMD yarn 12 and under one CMD yarn 11 and thereafter rising to the surface of the fabric to continue the repeat of the yarn. The floats over upper layer CMD yarns 11 of upper MD yarns 14, 16, 18 are staggered so that all of the upper and middle layer CMD yarns 11, 12 are maintained in the weave.

As will be recognized by those skilled in the art, the disclosed weave pattern with respect to FIGS. 1, 2, and 3, results in the top surface of the fabric having a twill pattern. Although the two-float twill pattern represented in FIGS. 1, 2, and 3 is a preferred embodiment, it will be recognized by those of ordinary skill in the art that the length of the float, the number of MD yarns in the repeat, and the ordering of the MD yarns may be selected as desired so that other patterns, twill or non-twill, are produced.

As best seen in FIGS. 2 and 3, lower MD yarns 15, 17, 19, weave directly beneath upper MD yarns 14, 16, 18, respectively, in a vertically stacked relationship. The lower yarns weave in an inverted image of their respective upper yarns. Each lower MD yarn 15, 17, 19 floats under two lower layer CMD yarns 13, rises into the fabric over one CMD yarn 13 and forms a knuckle around one middle layer CMD yarn 12 whereafter the yarn returns to the lower fabric surface to continue its repeat floating under the next two lower layer CMD yarns 13.

With respect to each pair of stacked yarns, the interior knuckle, formed around the middle layer CMD yarns 12 by one MD yarn, is hidden by the float of the other MD yarn. For example, in FIGS. 1 and 3, lower MD yarn 15 is depicted weaving a knuckle over CMD yarn 12 while MD yarn 14 is weaving its float over CMD yarns 11, thereby hiding the interior knuckle of lower MD yarn 15. Likewise, with respect to FIGS. 1 and 3, upper MD yarn 18 is depicted weaving a knuckle under yarn CMD yarn 12 while it is hidden by lower MD yarn 19 as it floats under CMD yarns 13.

The upper MD yarns 14, 16, 18, are woven contiguous with respect to each other. This maintains their respective parallel machine direction alignment and reduces permeability. Such close weaving of machine direction yarns is known in the art as 100% warp fill as explained in U.S. Pat. No. 4,290,209. As taught therein and used herein, actual warp count in a woven fabric may vary between about 80%–125% in a single layer and still be considered 100% warp fill.

The crowding of upper MD yarns 14, 16, and 18 also serves to force lower MD yarns 15, 17, 19, into their stacked position beneath respective upper MD yarns 14, 16, 18. Preferably lower MD yarns 15, 17, and 19 are the same size as upper MD yarns 14, 16, and 18 so that they are likewise woven in 100% warp fill. This results in the overall fabric of the preferred embodiment having 200% warp fill of MD yarns.

Since the lower MD yarns 15, 17, 19 are also preferably woven 100% warp fill, they likewise have the effect of maintaining the upper MD yarns 14, 16, 18 in stacked relationship with the respect to lower MD yarns 15, 17, 19. Accordingly, the respective MD yarn pairs 14 and 15, 16 and 17, 18 and 19 are doubly locked into position thereby enhancing the stability of the fabric.

As set forth in the U.S. Pat. No. 4,290,209, it has been recognized that machine direction flat yarns will weave in closer contact around cross machine direction yarns than round yarns. However, a 3:1 aspect ratio, i.e., cross sectional width to height was viewed as a practical limit for such woven yarns in order to preserve overall fabric stability. The present stacked MD yarn system preserves the stability and machine direction strength of the fabric and enables the usage of yarns with increased aspect ratio to more effectively control permeability.

The high aspect ratio of the MD yarns translates into reduced permeability. High aspect ratio yarns are wider and thinner than conventional flat yarns which have aspect ratios less than 3:1 and the same cross-sectional area. Equal cross-sectional area means that comparable yarns have substantially the same linear strength. The greater width of the high aspect ratio yarns translates into fewer interstices over the width of the fabric than with conventional yarns so that fewer openings exist in the fabric through which fluids may flow. The relative thinness of the high aspect ratio yarns enables the flat MD yarns to more efficiently cradle, i.e. brace, the cross machine direction yarns to reduce the size of the interstices between machine direction and cross machine direction yarns.

As illustrated in FIG. **4*a*, when the fabric 10 is woven the three layers of CMD yarns 11, 12, 13** become compressed. This compression along with the relatively thin dimension of the MD yarns reduces the caliper of the fabric. Accordingly, the overall caliper of the fabric can be maintained relatively low and not significantly greater than conventional fabrics woven without stacked MD yarn pairs. In the above example, the caliper of the finished fabric was 0.050 inches.

It will be recognized by those of ordinary skill in the art that if either top MD yarns 14, 16, 18 or bottom MD yarns 15, 17, 19 are woven at 100% warp fill, the overall warp fill for the stacked fabric will be significantly greater than 100% which will contribute to the reduction of permeability of the fabric. The instant fabric having stacked MD yarns will be recognized as having a significantly greater percentage of a warp fill than fabrics which have an actual warp fill of 125% of non-stacked MD yarns brought about by crowding and lateral undulation of the warp strands. Although the 200% warp fill is preferred, a fabric may be woven having 100% fill for either the upper or lower MD yarns with a lesser degree of fill for the other MD yarns by utilizing yarns which are not as wide as those MD yarns woven at 100% warp fill. For example, upper yarns 14, 10 16, 18 could be 1 unit wide with lower layer yarns 15, 17, 19 being 0.75 units wide which would result in a fabric having approximately 175% warp fill.

Such variations can be used to achieve a selected degree of permeability. Alternatively, such variations could be employed to make a forming fabric. In such a case, the lower MD yarns would be woven 100% warp fill to define the machine side of the fabric and the upper MD yarns would be woven at a substantially lower percentage of fill to provide a more open paper forming surface.

Figure 4A:
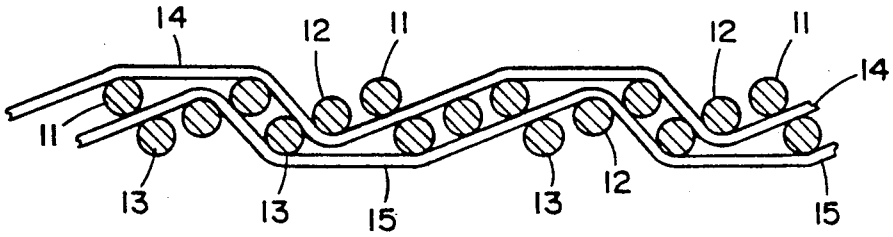
FIG. 4*a* illustrates the yarn orientation in the fabric depicted in FIG. 1 after the fabric is finished showing only two representative stacked MD yarns.
Figure 4B:
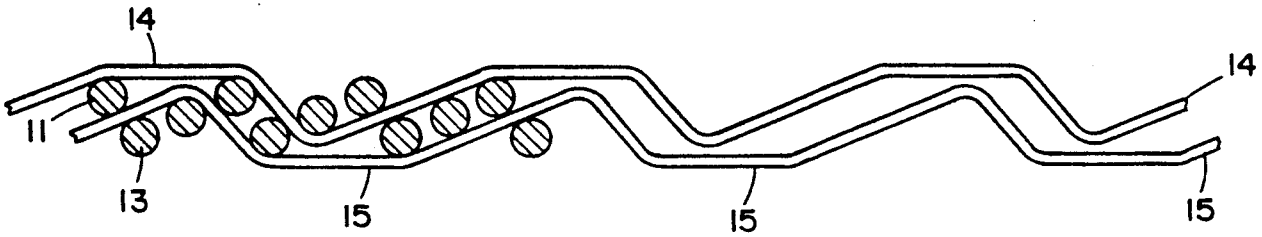
FIG. 4*b*, 4*c*, and 4*d* are a series of illustrations showing the formation of a seaming loop for the papermakers fabric depicted in FIG. 1.
Figure 4C:
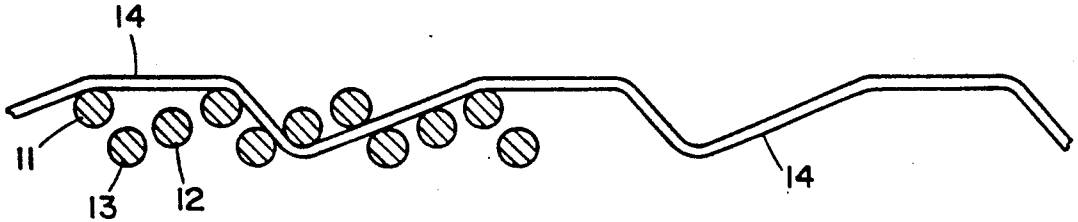
Figure 4D:
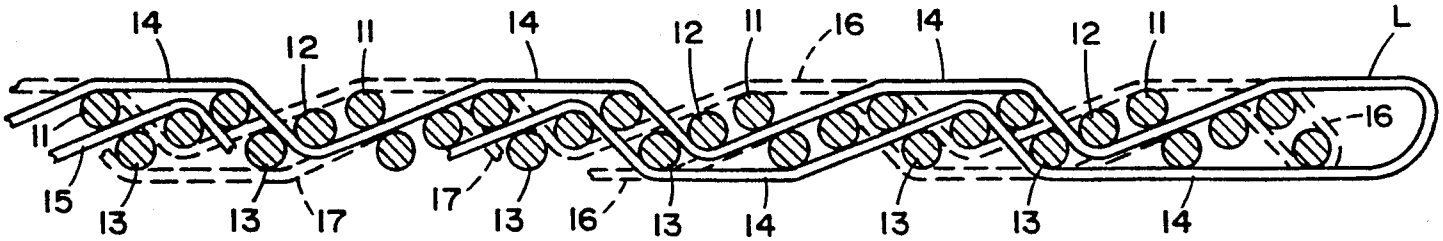

The stacked pair MD weave permits the formation of orthogonal seaming loops within MD yarns. With reference to FIGS. **4*a–d*, after the fabric has been woven and heat set (FIG. 4*a*), CMD yarns are removed leaving the crimped MD yarns 14, 15 exposed (FIG. 4*b*). One of the yarns, for example, MD lower yarn 15, of the stacked pair is trimmed back a selected distance leaving the other exposed MD yarn 14 of the MD yarn pair and vacated space between the CMD yarns, as illustrated in FIG. 4***c*. Upper MD yarn 14 is then backwoven into the space vacated in the weave pattern by lower MD yarn 15 such that a loop L is formed on the end of the fabric, as illustrated in FIG. 4*d*. Preferably, between 0.5–5.0 inches of upper layer yarn 14 is backwoven into the fabric to provide sufficient strength for the end loop and assure retention of the free end of MD yarn 14 within the weave of the fabric. The inverted image weave permits the crimp of the upper MD yarn 14 to match the space vacated by the lower MD yarn 15 which further enhances the strength of the end loop.

As shown in phantom in FIG. 4*d*, adjacent yarn pair 16, 17 is processed in a similar manner. However, when upper yarn 16 is looped back and backwoven in the fabric, it is pulled against the CMD yarns. In the preferred embodiment, wherein the upper MD yarns are woven 100% fill, the crowding of the yarns secure the orthogonal orientation of the seaming loops.

To achieve a uniform seam for a fabric woven in accordance with the weave pattern depicted in FIGS. 1–4, each upper MD yarn 14 forms a loop and the other upper MD yarns 16, 18 are backwoven against the endmost CMD yarn of the fabric. Thus every third upper MD yarn defines a loop such that an array of loops is created on each end of the fabric. The seam is assembled by intermeshing the opposing arrays of loops and inserting a pintle yarn between the intermeshed loops.

Preferably, loop forming yarns 14 would all be backwoven approximately the same distance within the fabric to provide sufficient strength to prevent the loops from being pulled apart during normal usage. Non-loop forming yarns 16, 18, would preferably be backwoven a somewhat shorter distance since during usage no load is imparted to those yarns. For example, upper MD yarns 14 would be backwoven approximately 3 inches, MD yarns 16 would be backwoven approximately 2 inches, and MD yarns 18 would be backwoven approximately 1 inch. Respective lower layer yarns 15, 17, 19 would be trimmed to complement the backweaving of their respective MD yarn pair yarns 14, 16, 18.

Figure 5A:
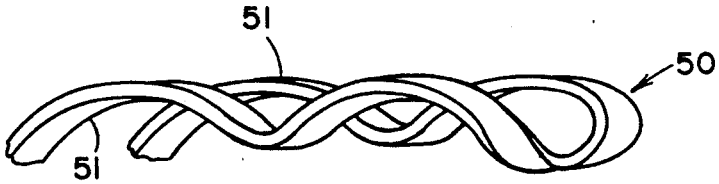
FIG. 5a (PRIOR ART)
FIG. 5*a* is a perspective view of a prior art MD yarn seaming loop.
Figure 5B:
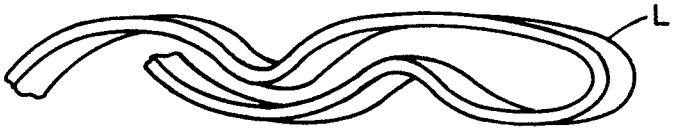
FIG. 5*b* is a perspective view of an orthogonal MD yarn seaming loop made in accordance with the present invention.

FIGS. 5*a* and 5*b*, respectively, illustrate a conventional seaming loop 50 in comparison with an orthogonal seaming loop L of the present invention. In conventional loop forming techniques, the MD yarn 51 is backwoven into the fabric adjacent to itself thereby inherently imparting twist and/or torque to the loop structure 50. In the present invention, the MD yarn is looped directly beneath itself and does not have any lateral offset which would impart such twist or torque to the seaming loop.

Figure 6:
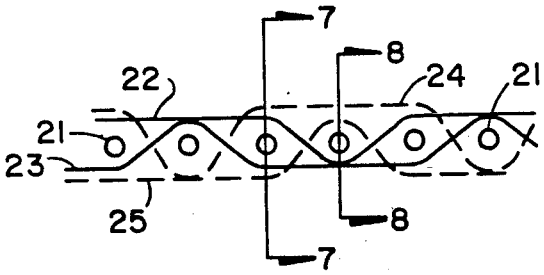
FIG. 6 is a schematic view of a second embodiment of a fabric made in accordance with the teachings of the present invention.
Figure 7:
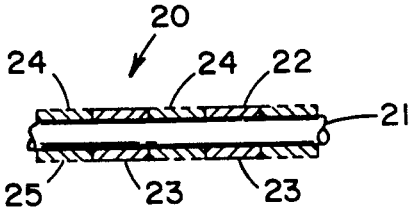
FIG. 7 is a cross-sectional view of the fabric depicted in FIG. 6 along line 7—7.
Figure 8:
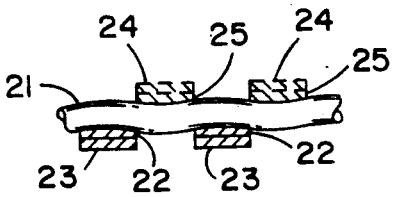
FIG. 8 is a cross-sectional view of the fabric depicted in FIG. 6 along line 8—8.

Referring to FIGS. 6, 7 and 8, there is shown an alternate embodiment of a fabric 20 made in accordance with the teachings of the present invention. Papermakers fabric 20 is comprised of a single layer of CMD yarns 21 interwoven with a system of stacked MD yarns 22–25 which weave in a selected repeat pattern. The MD yarn system comprises upper MD yarns 22, 24 which define floats on the top surface of the fabric 20 by weaving over three CMD yarns 21, dropping into the fabric to form a knuckle around the next one CMD yarn 21, and thereafter continuing to float over the next three CMD yarns 21 in the repeat.

Lower MD yarns 23, 25, weave directly beneath respective upper MD yarns 22, 24 in a vertically stacked relationship. The lower MD yarns weave in an inverted image of their respective upper MD yarns. Each lower MD yarn 23, 25 floats under three CMD yarns 21, weaves upwardly around the next one CMD yarn forming a knuckle and thereafter continues in the repeat to float under the next three CMD yarns 21.

As can be seen with respect to FIGS. 6 and 8, the knuckles formed by the lower MD yarns 23, 25 are hidden by the floats defined by the upper MD yarns 22, 24 respectively. Likewise the knuckles formed by the upper MD yarns 22, 24 are hidden by the floats of the lower MD yarns 23, 25 respectively.

The caliper of the fabric proximate the knuckle area shown in FIG. 8, has a tendency to be somewhat greater than the caliper of the fabric at non-knuckle CMD yarns 21, shown in FIG. 7. However, the CMD yarns 21 around which the knuckles are formed become crimped which reduces the caliper of the fabric in that area as illustrated in FIG. 8.

Figure 9:
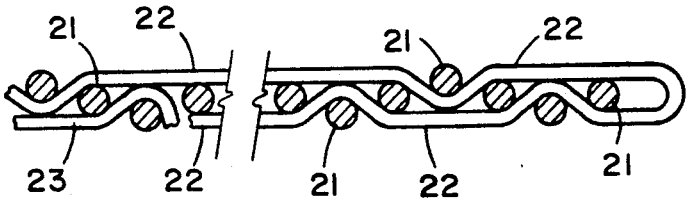
FIG. 9 illustrates the yarn orientation in the finished fabric depicted in FIG. 1 showing the end loop formed by one of the MD yarns.

As best seen in FIG. 9, seaming loops are formed by upper MD yarns 22. The respective lower MD yarns 23 are trimmed a selected distance from the fabric end and the upper MD yarns 22 are backwoven into the space vacated by the trimmed lower MD yarns 23.

Upper MD yarns 24 are similarly backwoven into the space vacated by trimming back lower MD yarns 25. However, as best seen in FIG. 10, upper MD yarns 24 are backwoven against the endmost CMD yarn 21.

Figure 10:
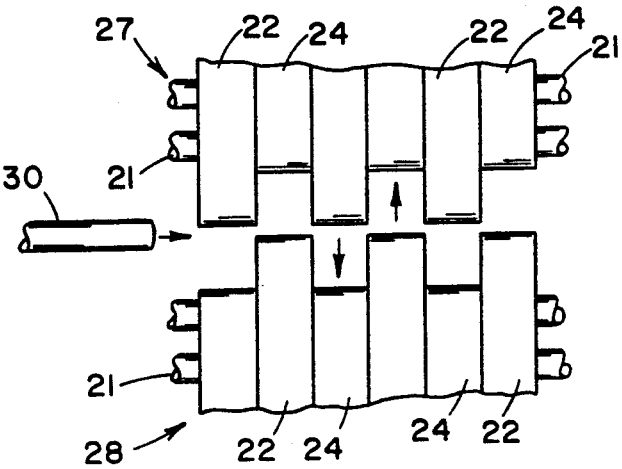
FIG. 10 is a top view of the opposing ends of a fabric constructed in accordance with FIG. 6 just prior to pin-seaming the ends together.

As illustrated in FIG. 10, a series of seaming loops is formed on each of the opposing fabric ends 27, 28. When the fabric is installed on papermaking equipment, the respective end loops formed by MD yarns 22 are intermeshed and a pintle 30 is inserted therethrough to lock the intermeshed series of loops together.

Since the seaming loops L are formed by backweaving MD yarns 22 directly beneath themselves, no lateral twist or torque is imparted on the loop and the loops are orthogonal with the plane of the fabric. This facilitates the intermeshing of the loop series of the opposing fabric ends 27, 28. The orthogonal loops are particularly advantageous where, as shown in FIG. 10, the MD yarns 22, 24 are 100% warp fill and adjacent loops are separated by individual MD yarns of the same width as the loop MD yarns 22. Lateral torque or twist on the seaming loops make the seaming process more difficult particularly where the loop-receiving gaps between the loops of one fabric end are essentially the same width as the loops on the opposing fabric end and vice versa.

With reference to the fabric depicted in FIGS. 6–10, the loop forming MD yarns 22 are preferably backwoven approximately 2 inches while the non-loop forming MD yarns 24 are preferably backwoven 1 inch.

I claim:

1. A papermakers fabric having opposite ends comprising:

a system of flat monofilament MD yarns interwoven with a system of CMD yarns;

a series of orthogonal end loops formed on each end of said fabric from selected MD yarns which are looped back and interwoven with said CMD yarns directly beneath themselves; and said MD yarns comprise paris of vertically aligned upper and lower MD yarns with the orthogonal end loops formed from upper MD yarns and the respective lower MD yarns are trimmed back a selected distance from the end of the fabric such that the looped MD yarns are interwoven with said CMD yarns in the space vacated by the respective trimmed lower MD yarn.

2. A papermakers fabric according to claim 1 wherein:

all orthogonal end loop forming upper MD yarns are interwoven with said CMD yarns directly beneath themselves;

all lower MD yarns are trimmed back a selected distance from the end of the fabric; and the remaining upper MD yarns are interwoven with the CMD yarns directly beneath themselves and retain the endmost CMD yarns in the fabric.

3. A papermakers fabric according to claim 2 wherein:

the orthogonal end loop forming upper MD yarns are all back woven substantially the same distance into the end of the fabric which distance is greater than the back weaving of the remaining upper MD yarns; and the lower MD yarns which are paired with loop forming upper MD yarns are trimmed back a greater distance from the end of the fabric than the remaining lower MD yarns.

4. A papermakers fabric according to claim 2 wherein at least said upper MD yarns are 100% fill.

5. A papermakers fabric according to claim 2 wherein said lower MD yarns are interwoven with said CMD yarns in an inverted image of the respective upper MD yarns of said MD yarn pairs.

6. A papermakers fabric according to claim 2 wherein every second upper MD yarn on each end of the fabric is an orthogonal loop forming yarn.

7. A papermakers fabric according to claim 2 wherein every third upper MD yarn on each end of the fabric is an orthogonal loop forming yarn.

8. A papermakers fabric according to claim 2 wherein at least said upper MD yarns have an aspect ratio of at least 3:1.

9. A papermakers fabric according to claim 2 wherein said CMD yarn system comprises a single layer of CMD yarns.

10. A papermakers fabric comprised of a system of MD yarns interwoven with a single layer of CMD yarns and a series of orthogonal end loops formed on opposing ends of said fabric from selected MD yarns which loop back and interweave with the CMD yarns directly beneath themselves wherein said MD yarns comprise pairs of vertically aligned upper and lower MD yarns with the orthogonal end loops formed from upper MD yarns and the respective lower MD yarns are trimmed back a selected distance from the end of the fabric such that the looped MD yarns are interwoven with said CMD yarns in the space vacated by the respective trimmed lower MD yarn.

11. A papermakers fabric according to claim 10 wherein:

all orthogonal end loop forming upper MD yarns are interwoven with said CMD yarns directly beneath themselves;

all lower MD yarns are trimmed back a selected distance from the end of the fabric; and the remaining upper MD yarns are interwoven with the CMD yarns directly beneath themselves and retain the endmost CMD yarns in the fabric.

12. A papermakers fabric according to claim 11 wherein:

the orthogonal end loop forming upper MD yarns are all back woven substantially the same distance into the end of the fabric which distance is greater than the back weaving of the remaining upper MD yarns; and the lower MD yarns which are paired with loop forming upper MD yarns are trimmed back a greater distance from the end of the fabric than the remaining lower MD yarns.

13. A papermakers fabric according to claim 11 wherein at least said upper MD yarns are 100% fill.

14. A papermakers fabric according to claim 11 wherein said lower MD yarns are interwoven with said CMD yarns in an inverted image of the respective upper MD yarns of said MD yarn pairs.

15. A papermakers fabric according to claim 11 wherein every second upper MD yarn on each end of the fabric is an orthogonal loop forming yarn.

16. A papermakers fabric according to claim 11 wherein every third upper MD yarn on each end of the fabric is an orthogonal loop forming yarn.

17. A papermakers fabric according to claim 11 wherein at least said upper MD yarns have an aspect ratio of at least 3:1.

18. A papermakers fabric having:

at least one system of 100% fill monofilament MD yarns interwoven with a system of CMD yarns to define an open fabric with opposing ends;

each opposed end having a first set of said MD yarns looped back and interwoven with said CMD yarns directly beneath themselves to define a series of orthogonal end loops; and each opposed end having a second set of said MD yarns, interspersed between the first set, looped back and interwoven with said CMD yarns directly beneath themselves to retain the endmost CMD yarns in the fabric.

19. A papermakers fabric according to claim 18 wherein:

said MD yarns comprise pairs of vertically aligned upper and lower MD yarns with the orthogonal end loops formed from upper MD yarns and the respective lower MD yarns trimmed back a selected distance from the end of the fabric such that the looped MD yarns are interwoven with said CMD yarns in the space vacated by the respective trimmed lower MD yarns.

* * * * *